US007360602B2

(12) United States Patent
Kritzler et al.

(10) Patent No.: US 7,360,602 B2
(45) Date of Patent: Apr. 22, 2008

(54) BARRIER ORIFICE VALVE FOR GAS LIFT

(75) Inventors: James H. Kritzler, Pearland, TX (US); James H. Holt, Conroe, TX (US); Vic Randazzo, Houston, TX (US); Walt R. Chapman, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 177 days.

(21) Appl. No.: 11/347,442

(22) Filed: Feb. 3, 2006

(65) Prior Publication Data

US 2007/0181312 A1 Aug. 9, 2007

(51) Int. Cl.
*E21B 43/00* (2006.01)

(52) U.S. Cl. ..... 166/372; 166/332.8

(58) Field of Classification Search ..... 166/372, 166/386, 117.5, 332.8
See application file for complete search history.

(56) References Cited

U.S. PATENT DOCUMENTS 2,634,689 A 4/1953 Walton ..... 103/233
4,854,387 A * 8/1989 Pringle ..... 166/321
5,004,007 A 4/1991 Johnson et al. ..... 137/501
5,971,004 A * 10/1999 Pringle ..... 137/155
6,568,473 B2 5/2003 De Almeida ..... 166/250.15
6,715,550 B2 4/2004 Vinegar et al. ..... 166/250.15
6,810,955 B2 11/2004 Roth et al. ..... 166/242.5
6,932,581 B2 8/2005 Messick ..... 417/54

FOREIGN PATENT DOCUMENTS

WO WO 2005/093209 A1 10/2005

* cited by examiner

*Primary Examiner*—William P Neuder
(74) *Attorney, Agent, or Firm*—Shawn Hunter

(57) ABSTRACT

Gas lift valve designs and gas lift systems are described that feature a positive closure mechanism that is highly resistant to significant wear or damage that would result in fluid leakage. A pivotable flapper member is incorporated into a gas lift valve and used as a flow control mechanism. The flapper member provides a positive barrier to fluid flow from the production tubing to the annulus, even after substantial wear or damage.

17 Claims, 6 Drawing Sheets

BARRIER ORIFICE VALVE FOR GAS LIFT

BACKGROUND OF THE INVENTION

1. Field of the Invention

The invention relates generally to gas lift arrangements used for enhanced recovery of hydrocarbons. In particular aspects, the invention relates to the construction and operation of gas lift valves used in hydrocarbon-producing wellbores.

2. Description of the Related Art

The flow of fluids into a wellbore from a surrounding subterranean reservoir often occurs as a result of natural formation pressure. This pressure is sometimes sufficient to lift oil within the wellbore to the surface for production. Sometimes, however, the formation pressure is not sufficient, and, even under the impetus of surface pumps, the rate of production is slow. In this case, techniques can be used to help improve the rate of production. One well-known technique for enhancing the rate of production is known as artificial lift, or gas lift. Gas lift valves are incorporated into the production tubing string and are used to flow high pressure natural gas from the annulus to the interior of the production tubing. The injected lighter gas provides a lift to the column of fluid within the production tubing to assist the flow of fluid from the well.

Gas lift valves must reliably provide for one-way fluid flow from the annulus to the interior of the tubing in order to prevent the undesirable leakage of production fluids into the annulus when the well is producing or closed in for maintenance or repair. Unfortunately, many conventional gas lift valve designs are prone to wear and damage during operation that can lead to seal failure and leakage over time. Conventional designs for gas lift valves usually incorporate a check dart or poppet member that is spring biased against a seat within the valve. Examples of valves having this type of construction are found in U.S. Pat. Nos. 6,932,581 and 6,715,550.

Flapper valves are known devices, but have been chiefly used as a safety valve mechanism within the flowbore of production tubing. Their function has been to prevent blowouts and emergencies by entirely closing off flow of fluid through the flowbore of a production tubing string. An example of a conventional flapper valve is shown in U.S. Pat. No. 6,705,593 issued to Deaton. To the inventors' knowledge, flapper mechanisms have not heretofore been incorporated into gas lift valves of any variety.

The present invention addresses the problems of the prior art.

SUMMARY OF THE INVENTION

The invention provides gas lift valve designs that feature a positive closure mechanism that is highly resistant to significant wear or damage that would result in fluid leakage. A pivotable flapper member is incorporated into a gas lift valve and used as a flow control mechanism. The flapper member provides a positive barrier to fluid flow from the production tubing to the annulus, even after substantial wear or damage. The flapper member is operated between open and closed positions by an axially moveable flow tube that is responsive to pressure changes in the injected gas. In a currently preferred embodiment, a flow restriction within the flow tube creates a pressure differential that moves the flow tube within a valve housing.

In described embodiments, the flapper members may be emplaced in either an externally-mounted gas lift valve or within a side-pocket mandrel integrated into the production tubing string. In further aspects of the invention, multiple barrier orifice valves may be used to optimize flow rates or to prevent backflow to another gas lift valve.

BRIEF DESCRIPTION OF THE DRAWINGS

Understanding of the present invention is best had with reference to the following drawings, among which like components are numbered alike.

DETAILED DESCRIPTION OF THE PREFERRED EMBODIMENTS

Figure 1:
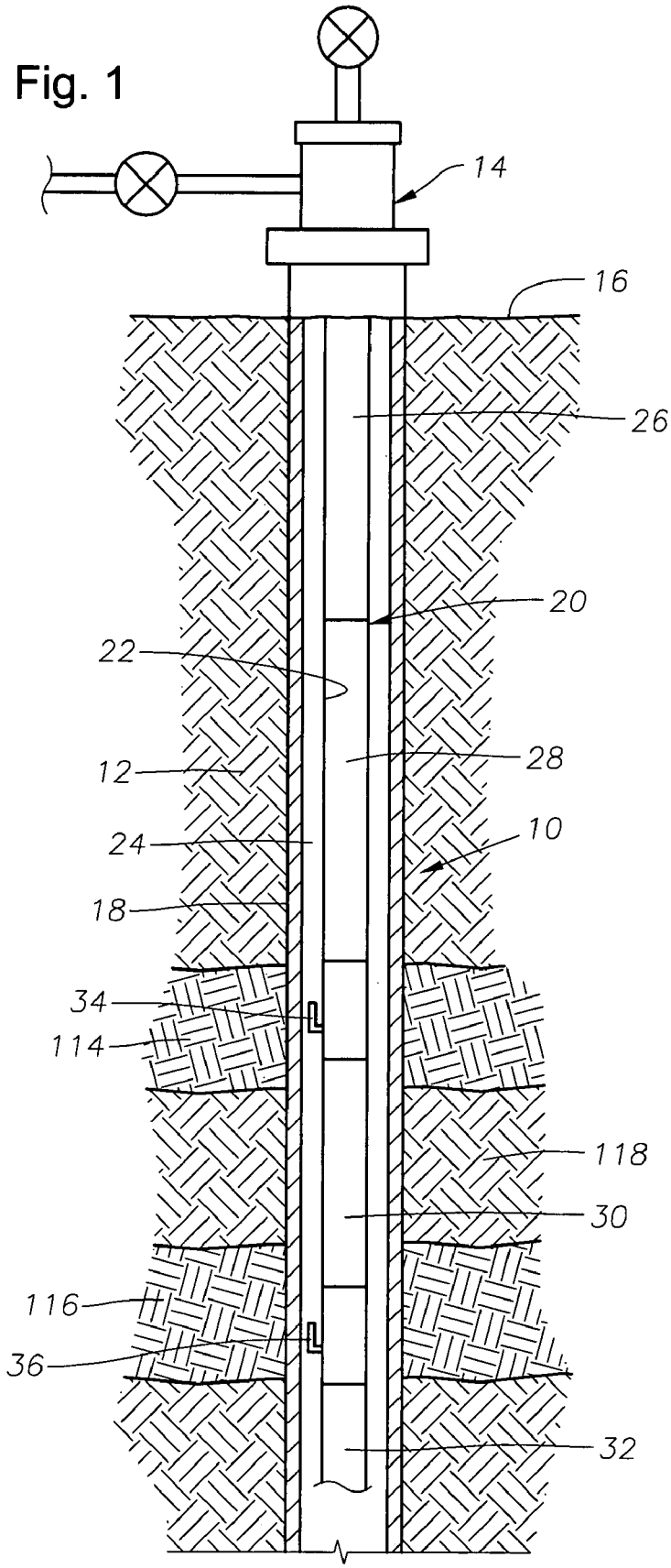
FIG. 1 is a side, cross-sectional view of an exemplary wellbore containing a production string having a number of gas lift valves incorporated therein.

FIG. 1 illustrates an exemplary subterranean wellbore 10 passing through the earth 12 from a wellhead 14 at the surface 16. The wellbore 10 is lined with casing 18, as is known in the art. A production tubing string 20 is disposed within the wellbore 10 from the wellhead 14 and defines an axial flowbore 22 along its length. As those of skill in the art will understand, the production tubing string 20 extends downwardly to sets of production nipples or other production arrangements (not shown) for obtaining hydrocarbons from a surrounding formation. An annulus 24 is defined between the production tubing string 20 and the casing 18.

The production tubing string 20 is made up of a number of production tubing sections 26, 28, 30, 32 that are secured in an end-to-end fashion with one another by threaded connection. Alternatively, the production tubing string 20 may be made up of coiled tubing that has been deployed from the surface 16 in a manner known in the art. Incorporated into the production tubing string 20 are two gas lift mandrels 34, 36. Those of skill in the art will understand that there may be more or fewer than two such gas lift mandrels, as the number of such mandrels is dictated by the requirements of production flow and well conditions.

Figure 2:
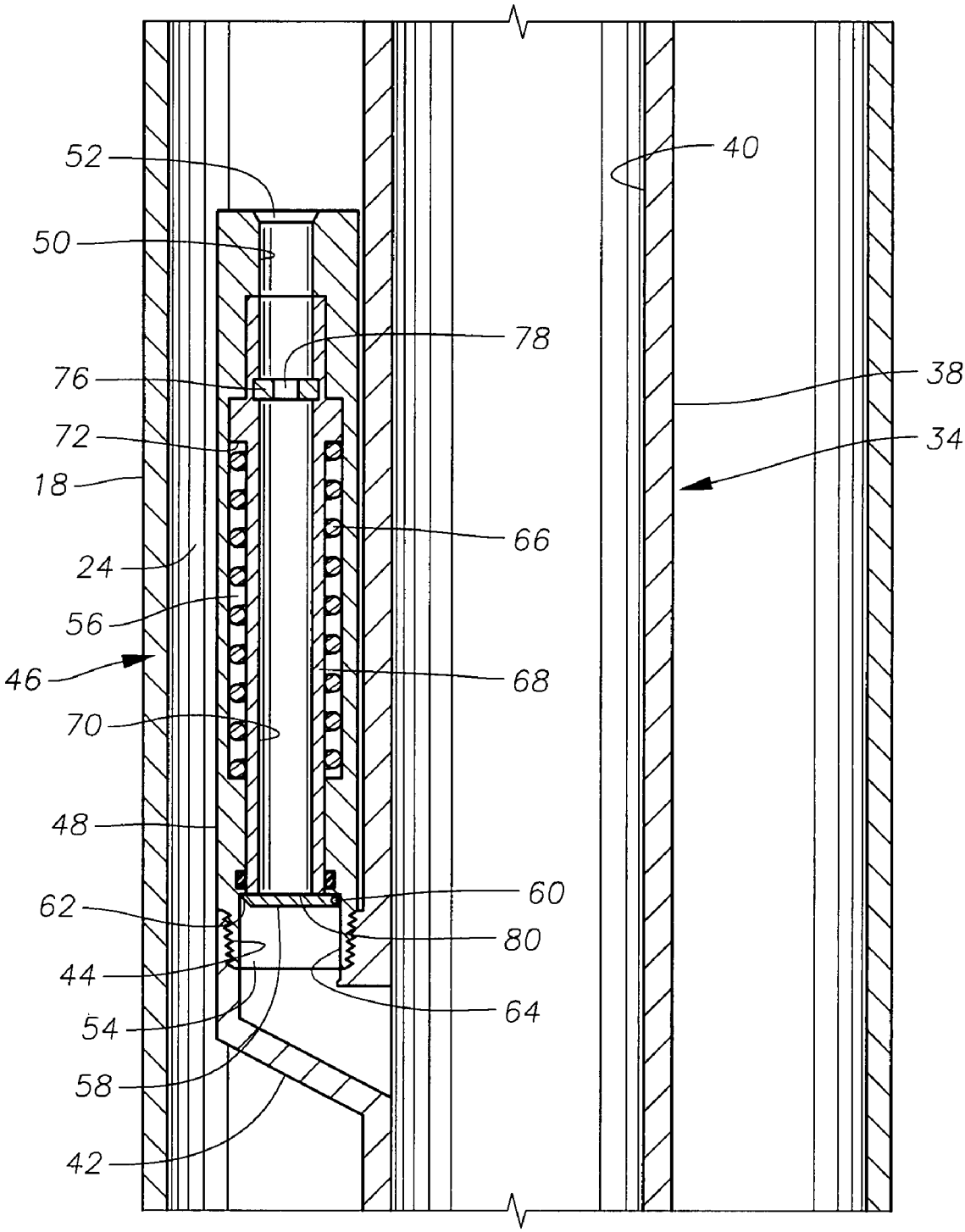
FIG. 2 is a side, cross-sectional view of a section of the production tubing string depicting in detail an externally-mounted gas lift valve constructed in accordance with the present invention.
Figure 3:
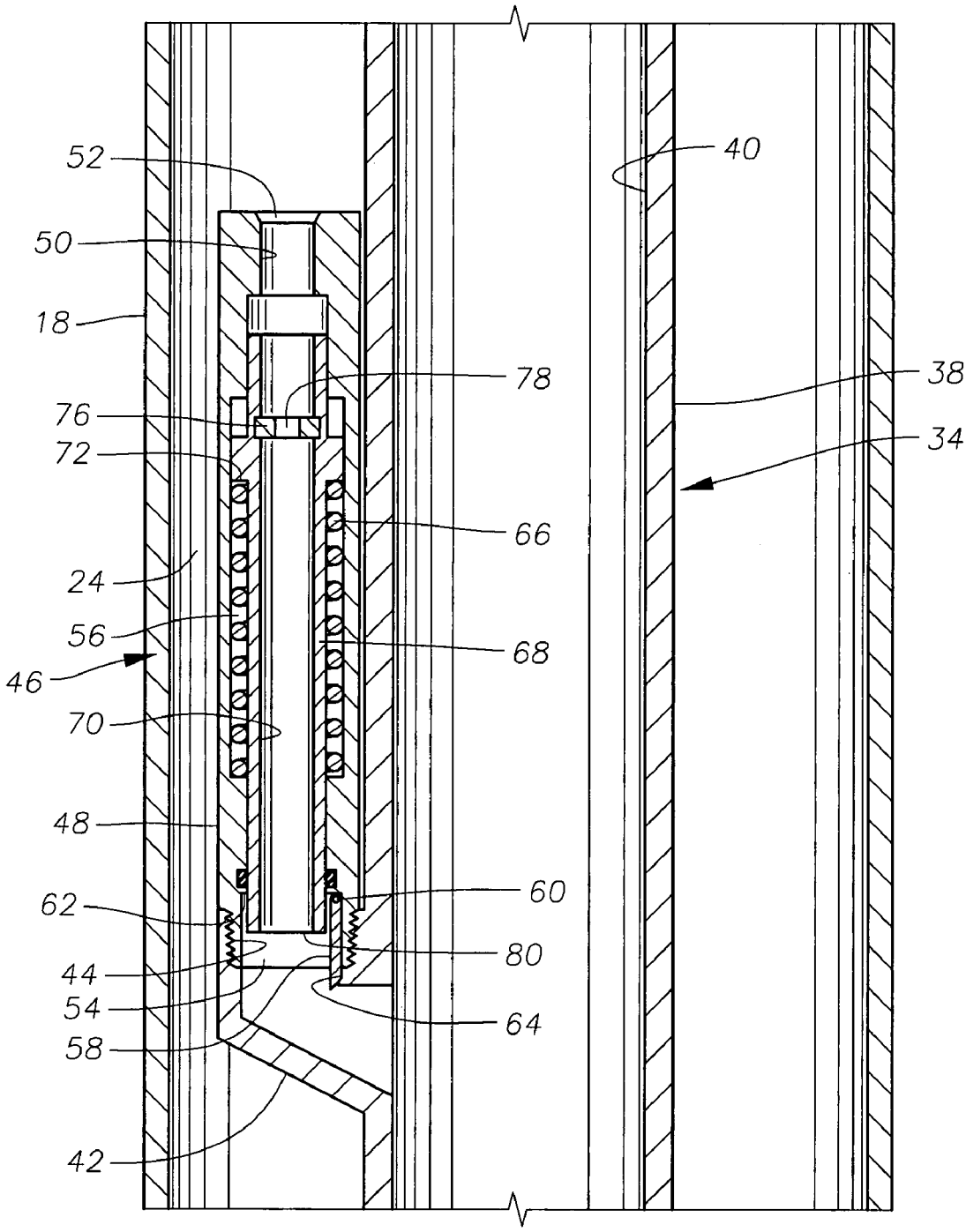
FIG. 3 is a side, cross-sectional view of the tubing section shown in FIG. 2, now with the gas lift valve in an open position.

FIGS. 2 and 3 illustrate in further detail the construction and operation of the gas lift mandrel 34. FIG. 2 depicts the gas lift mandrel 34 in its initial closed position, while FIG. 3 shows the gas lift mandrel 34 now in an opened position, as would occur during gas lift operations. It will be understood that the construction and operation of gas lift mandrel 36 may be identical to that of gas lift mandrel 34. The gas lift mandrel 34 has a tubular body 38 that defines a central flowbore portion 40. Those of skill in the art will appreciate that the body 38 will typically have threaded axial ends (not shown) for interconnection with adjacent tubular members within the tubing string 20. The body 38 has an outwardly-projecting side fitting 42 with threaded connection 44 for the attachment of externally-mounted barrier orifice gas lift valve 46. The gas lift valve 46 includes a valve housing or body 48 defining a fluid pathway 50 therethrough. The housing 48 presents a fluid inlet 52 at one axial end that is in fluid communication with the annulus 24. Additionally, a fluid outlet 54 is in fluid communication with the flowbore 40. The fluid pathway 50 of the gas lift valve 46 features an enlarged central bore portion 56 that serves as a spring chamber.

Proximate the fluid outlet 54, a flapper member 58 is pivotably secured to the valve housing 48 at hinge point 60 and is pivotably moveable about the hinge point 60. The flapper member 58 is a plate-type member that is shaped and sized to selectively close off fluid flow through the fluid pathway 50. The flapper member 58 is moveable about the hinge point 60 between a closed position (shown in FIG. 2), wherein fluid flow through the fluid pathway 50 is closed off, and an open position (shown in FIG. 3), wherein fluid flow is permitted through the fluid pathway 50. When closed, the flapper member 58 contacts a complimentary-shaped seat 62 and forms a fluid seal thereagainst. When in the open position, the flapper member 58 resides within flapper recess 64. The flapper member 58 is urged toward a closed position by a torsional spring (not shown), which is associated with the hinge point 60. Torsional springs of this type are well-known.

The enlarged central bore portion 56 of the fluid pathway 50 houses a compression spring member 66 and a flow tube 68 that resides axially within the spring 66. The flow tube 68 is axially moveable with respect to the valve housing 48 and defines a central tubular bore 70 along its length. The outer radial surface of the flow tube 68 presents an enlarged diameter shoulder 72 against which the upper end of the compression spring 66 abuts. This arrangement biases the flow tube 68 upwardly and away from the flapper member 58, or toward an unactuated position.

An orifice plate 76 is securely affixed within the bore 70 of the flow tube 48. The orifice plate 76 contains a flow-restrictive orifice 78. The lower end 80 of the flow tube 48 abuts the flapper member 58 when the flapper member 58 is in the closed position.

During a gas lift operation, natural gas or another light fluid is injected into the annulus 24 from the wellhead 14 under pressure. The gas then enters the fluid inlet 52 of the valve housing 48 and exerts force against both the flapper member 58 and the orifice plate 76. The injected gas urges the flapper member 58 off its seat 62 so that gas can flow through the orifice 78, bore 70 and fluid outlet 54 into the flowbore 40 of the mandrel body 38 and, thus, into the flowbore 22 of the production tubing string 20. Additionally, the injected gas creates a pressure differential across the orifice plate 76 due to the restriction formed by the orifice 78. The creation of a pressure differential across an orifice plate in this fashion is a well-known phenomenon. This pressure differential urges the flow tube 48 axially downwardly so that the lower end 80 of the flow tube 48 is urged against the flapper member 58 to pivot it toward its open position and retain the flapper member 58 within the flapper recess 64.

Once gas lift injection has stopped, or been reduced sufficiently, the pressure differential across the orifice plate 76 will be reduced. The compression spring 66 will exert spring force against the shoulder 72 of the flow tube 48 to urge it radially upwardly with respect to the valve housing 48. As this occurs, the lower end 80 of the flow tube 48 will be raised to permit the flapper member 58 to return to the closed position shown in FIG. 2 under the impetus of the torsion spring associated with the hinge point 60.

Figure 4:
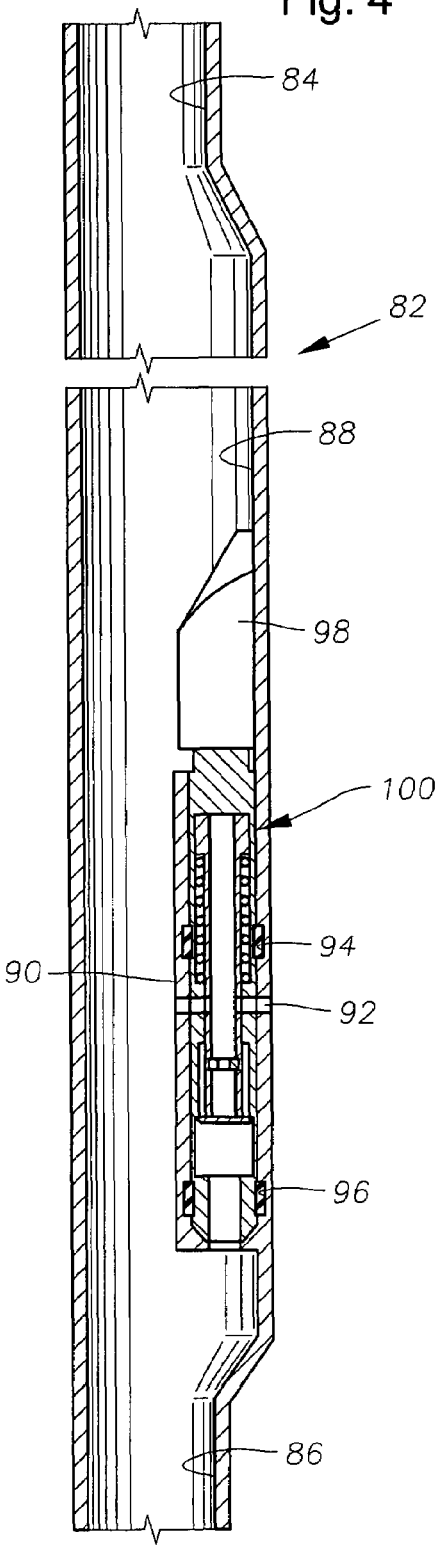
FIG. 4 is a side, cross-sectional view of an alternative embodiment of the invention wherein a gas lift valve is secured within a side pocket mandrel within the production tubing string.
Figure 5:
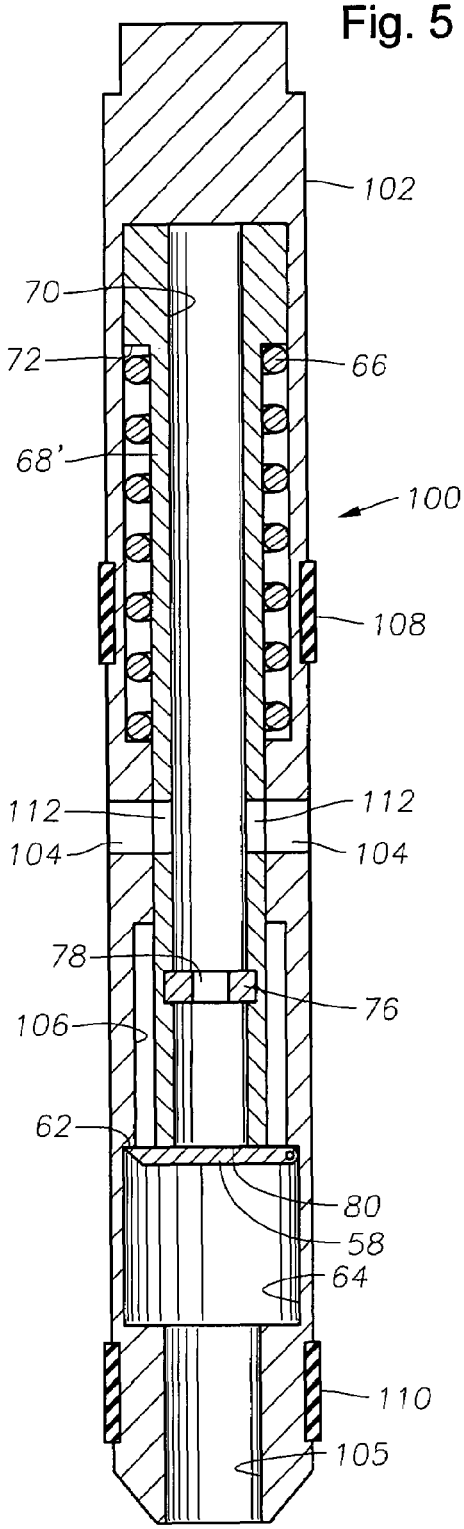
FIG. 5 is an enlarged view of the gas lift valve used in the side pocket mandrel shown in FIG. 4.

FIGS. 4 and 5 illustrate an alternative embodiment of the invention wherein a gas lift valve constructed in accordance with the present invention is incorporated into a side pocket mandrel. FIG. 4 depicts side pocket mandrel 82 which, as an alternative to gas lift mandrel 34, may be incorporated into production tubing string 20. Gas lift side pocket mandrels are known in the art and described at least in U.S. Pat. No. 6,810,955 entitled "Gas Lift Mandrel" which is owned by the assignee of the present invention and herein incorporated by reference. The side pocket mandrel 82 features flow portions 84, 86 of standard flow area and an enlarged diameter flow portion 88. The enlarged diameter flow portion 88 includes a side pocket 90 for retention of tools such as a gas lift valve. A fluid opening 92 is disposed through the wall of the side pocket mandrel 82 to permit fluid flow from the annulus 24. The side pocket 90 includes upper and lower seal bores 94 and 96 which are located above and below the fluid opening 92, respectively. A latch profile 98, of a type known in the art, is located above the upper seal bore 94 to assist in the landing and securing of the gas lift valve 100 in the pocket 90.

Gas lift valve 100 is depicted in detail in FIG. 5. The gas lift valve 100 includes a valve body, or housing, 102 which is enclosed except for fluid inlets 104 and lower fluid outlet 105. The fluid outlet 105 is in fluid communication with the flowbore 88 when the gas lift valve 100 is disposed within the valve pocket 90. The valve body 102 defines an axial bore 106. The outer diameter of the valve body 102 presents upper and lower elastomeric fluid seals 108, 110. The upper seal 108 will seal into the upper seal bore 104 while the lower seal 110 will seal into the lower seal bore 106. When this is done, the fluid inlets 104 will align with the fluid openings 92.

A flapper member 58 is pivotably secured to the housing 102 at hinge point 60 and operates between open and closed positions in the manner described previously. A torsional spring (not shown) is used to bias the flapper member 58 toward the closed position.

The axial bore 106 of the valve body 102 contains a flow tube 68' and compressible spring member 66. The flow tube 68' is axially moveable within the bore 106 and contains lateral flow orifices 112 that generally align with the fluid inlets 104 in the valve housing 102. An outwardly-projecting shoulder 72 of the flow tube 68' contacts the upper end of the spring 66. As a result, the flow tube 68' is biased upwardly within the valve housing 102. Orifice plate 76 is located within the bore 70 of flow tube 78' between the fluid inlets 104 and the fluid outlet 105.

In operation, the gas lift valve 100 is removably emplaced within the side pocket 90 using wireline tools in a manner which is known in the art and described in, for example, U.S. Pat. No. 6,810,955. Injected gas within the annulus 24 will enter the valve 100 through the fluid inlets 92, inlets 104 and orifices 112. The fluid pressure from the injected gas will urge the flapper member 58 off its seat 62. Further the pressure differential across the orifice plate 76 will urge the flow tube 68' downwardly. The flapper member 58 will be moved to and retained in an open position, as described previously with respect to the gas lift valve 46. A release or reduction of fluid pressure within the annulus 24 will allow the flapper member 58 to re-close.

Multiple barrier orifice valves can be used to optimize the rate of flow of injected gas into the production fluid within the production tubing string 20. By adjusting the load rating of the gas lift valves, the gas lift valves can be tuned to open in response to various levels of fluid pressure within the annulus 24. This would allow a first valve to open at a relatively low pressure while a second valve would open only in response to a higher fluid pressure. This would allow a low rate of injection at lower pressures and a higher rate of injection at higher pressures. Those of skill in the art will recognize that the load rating of the gas lift valves can be set by making adjustments to one or more components within the valves, such as the force exerted by the torsional spring used to urge the flapper member 58 toward a closed position, the compressive force of the spring 66 used to bias the flow tube 68, 68', or the size of the orifice 78 in the orifice plate 76. For example, with respect to the apparatus depicted in FIG. 1, the upper gas lift mandrel 34 could be tuned to open in response to an annulus pressure of 5000 psi, while the lower gas lift mandrel 36 would only open in response to an annulus pressure of 10,000 psi.

Similarly, gas lift valves tuned to open at different annulus pressures can be used to regulate fluid injection rates into portions of the production tubing that are associated with different formation reservoirs that are physically isolated from one another. Referring again to FIG. 1, it is noted that the upper gas lift mandrel 34 is located proximate a first formation reservoir 114 while the lower gas lift mandrel 36 is located proximate a second formation reservoir 116. The first and second formation reservoirs 114, 116 are separated by a substantially impermeable layer 118 of rock. The upper reservoir 114 contains production fluid that is heavier than the production fluid in the lower reservoir 116. Therefore, the upper gas lift mandrel 34 should be tuned to open at a lower pressure than the lower gas lift mandrel 36. This will ensure that lift gas injection will occur first in the portion of the production tubing string 20 having heavier production fluid and increase the overall efficiency of production.

It is further noted that gas lift valves constructed in accordance with the embodiments 46, 100 may be used for the chemical treatment of production fluid through injection of suitable chemical fluids that are injected into the annulus 24. These chemical treatments can be used to protect the production tubing string 20 or to dissolve solids that tend to build up within the production tubing string 20 and impede or prevent efficient production. Water, for example, might be injected into the production tubing string 20 to help dissolve accumulated solids within.

Figure 6:
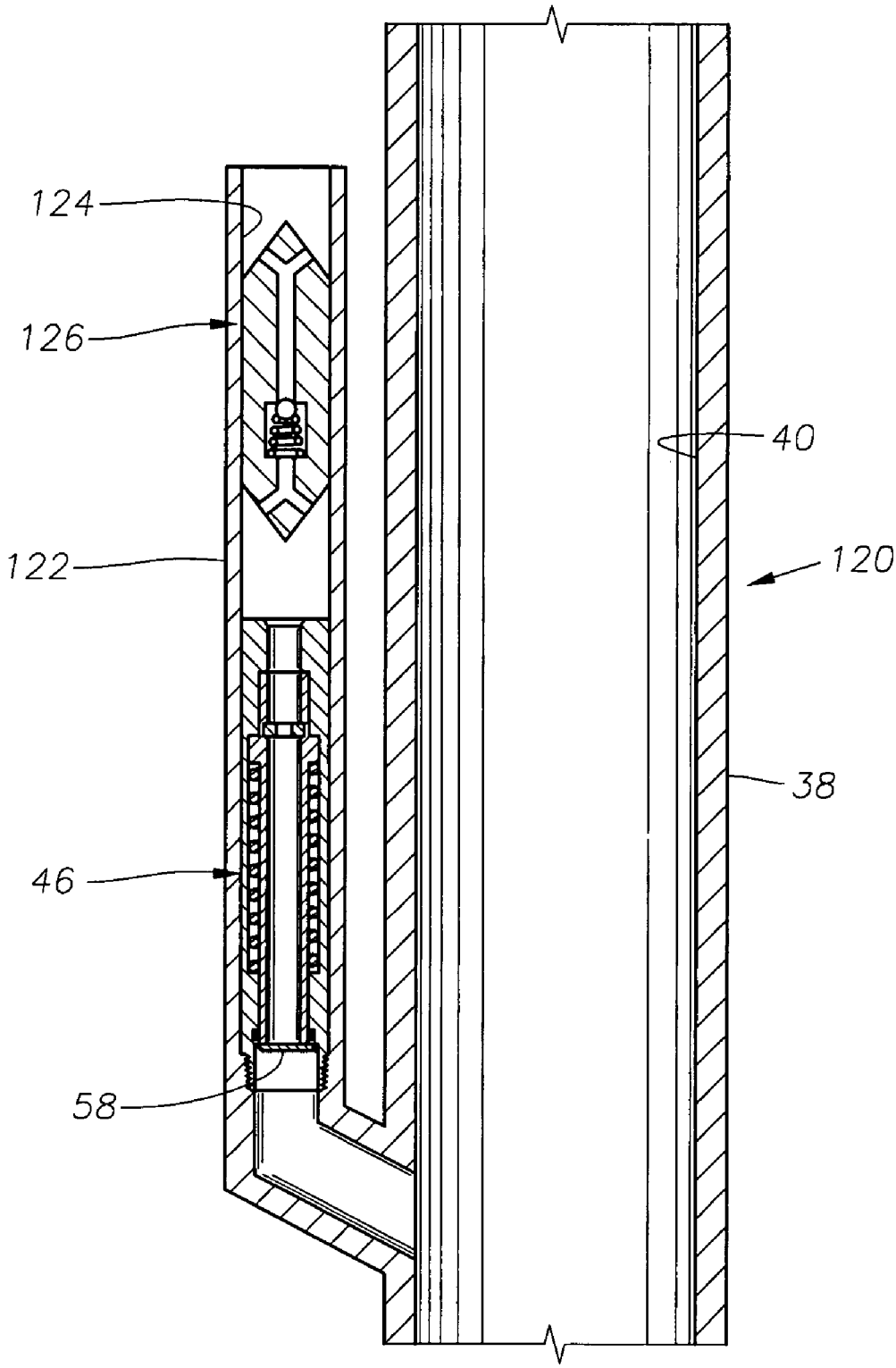
FIG. 6 depicts a gas lift valve assembly having a flapper-type closure mechanism in conjunction with a standard poppet-style flow control device.

The barrier orifice gas lift valves 46, 100 described above can be used in series with a conventional poppet-type gas lift flow control arrangement as well. FIG. 6 depicts such an arrangement in schematic terms. In FIG. 6, a gas lift mandrel 120 includes a side fitting 122 that defines a bore 124 that is of sufficient size and length to accommodate the placement of two gas lift valves. Barrier orifice gas lift valve 46 with flapper member 58 is secured within the bore 124 proximate its lower end. A poppet-style or bellows-style gas lift valve 126 of standard design is secured within the bore 124 proximate its upper end. During gas lift operations, both valves 46, 126 will be opened in response to increased fluid pressure within the annulus 24. Upon reduction in annulus pressure, both valves 46, 126 will close. Closure of the barrier orifice gas lift valve 46 will block backflow from the flowbore 40 to the conventional gas lift valve 126, thereby protecting it from damage or significant wear and preventing leakage out into the annulus 24.

Figure 7:
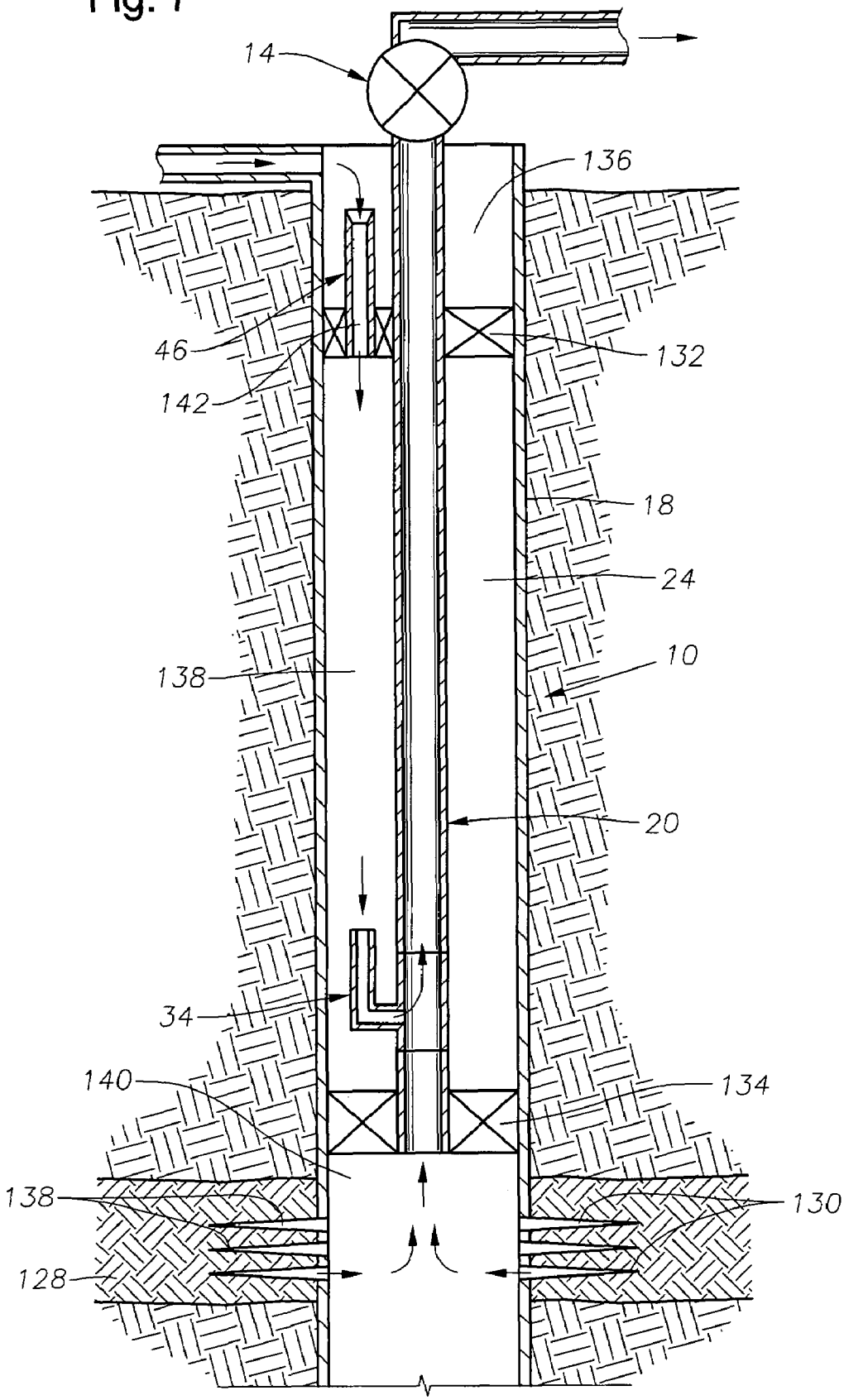
FIG. 7 depicts the use of a flapper-style valve as a pass-through valve for a packer within the wellbore.

FIG. 7 illustrates a gas lift arrangement wherein production is occurring from a reservoir formation 128 through perforations 130. The wellbore annulus 24 is divided by packers 132 and 134 into upper, intermediate and lower portions 136, 138, and 140, respectively. The upper packer 132 is a ported packer having an opening 142 passing axially through. A barrier orifice valve of the type described previously as gas lift valve 46 is secured within the opening 142. The barrier orifice valve 46 allows flow of fluid into the intermediate annulus portion 138 from the upper annulus portion 136, but contains a flapper member to close against reverse flow. Thus, the valve 46 protects the upper portion 136 of the annulus 24 from back flow.

Those of skill in the art will understand that the construction and operation of barrier orifice gas lift valves constructed in accordance with the present invention will provide improved safety for wells and, particularly for gas lift operations. The flapper member associated with the barrier orifice valves provides a positive barrier against reverse fluid flow which is highly resistant to leakage or failure from damage and wear.

Those of skill in the art will recognize that numerous modifications and changes may be made to the exemplary designs and embodiments described herein and that the invention is limited only by the claims that follow and any equivalents thereof.

What is claimed is:

1. A gas lift valve assembly for selectively controlled flow of fluid from an annulus of a wellbore into a flowbore of production tubing within the wellbore comprising:

a valve body having a fluid flow path with a fluid inlet and a fluid outlet;

the fluid inlet being in fluid communication with the annulus;

the fluid outlet being in fluid communication with the flowbore; and a flapper valve member retained within the valve body and moveable in response to pressure changes in the annulus between a closed position wherein fluid flow is blocked through the fluid flow path and an open position wherein fluid flow is permitted through the fluid flow path; and a gas lift valve disposed within the fluid flow path between the flapper valve member and the annulus so that the flapper valve member will block backflow of fluid to the gas lift valve.

2. The gas lift valve assembly of claim 1 further comprising a flow tube that is axially moveable within the valve body in response to pressure changes within the annulus, the flow tube being operable to move the flapper member toward the open position.

3. The gas lift valve assembly of claim 2 wherein the flow tube defines a bore having an orifice plate fixedly disposed therein.

4. The gas lift valve assembly of claim 1 wherein the valve body is shaped and sized to be removably disposed within a side pocket of a side pocket mandrel.

5. The gas lift valve assembly of claim 1 wherein the valve body is secured to a side fitting on the radial exterior of a gas lift mandrel within a production string.

6. The gas lift valve assembly of claim 1 wherein the flapper valve member is biased toward a closed position by a spring force.

7. The gas lift valve assembly of claim 2 wherein the flow tube is biased toward an unactuated position by a spring force.

8. A gas lift system for enhanced production of hydrocarbons in a wellbore, the system comprising:

a production tubing string defining a flowbore along its length and disposed within the wellbore to define an annulus between the tubing string and the wellbore;

a gas lift mandrel incorporated into the production tubing string;

a first gas lift valve associated with the gas lift mandrel, the gas lift valve having:

a valve body;

a flapper member flow control mechanism within the valve body that is pivotally secured to the valve body for pivoting movement between open and closed positions; and a second gas lift valve associated with the gas lift mandrel between the flapper member and the annulus so that the flapper valve member will block backflow of fluid to the first gas lift valve.

9. The gas lift system of claim 8 wherein the valve body defines a fluid flow path with a fluid inlet and a fluid outlet and wherein the fluid inlet is in fluid communication with the annulus and the fluid outlet is in fluid communication with the flowbore.

10. The gas lift system of claim 8 wherein the gas lift mandrel comprises a side pocket mandrel.

11. The gas lift system of claim 8 wherein the gas lift mandrel comprises:

a body portion defining an axial flowbore within;

a side fitting projecting radially outwardly from the body portion for attachment of the gas lift valve.

12. The gas lift system of claim 8 further comprising a second gas lift mandrel incorporated into the production tubing string, the second gas lift mandrel containing a third gas lift valve, the third gas lift valve having:

a valve body; and a flapper member flow control mechanism within the valve body that is pivotally secured to the valve body for pivoting movement between open and closed positions.

13. The gas lift system of claim 8 wherein the first gas lift valve further comprises a flow tube for operation of the flapper member between its closed and opened positions.

14. The gas lift system of claim 13 wherein the flow tube defines a bore having a flow restriction therein for development of a pressure differential for movement of the flow tube to operate the flapper member.

15. A method of performing a gas lift injection operation in a wellbore containing a production tubing string, the method comprising the steps of:

injecting fluid into an annulus defined between the production tubing string and the wellbore;

flowing the injected fluid into a gas lift valve from the annulus to open a pivoting flapper member within the gas lift valve;

flowing the injected fluid from the gas lift valve into the production tubing string; and using a second gas lift valve to prevent leakage from the first gas lift valve out into the annulus.

16. The method of claim 15 further comprising the step of reducing fluid pressure within the annulus to close the flapper member against fluid flow.

17. The method of claim 15 wherein the step of opening a pivoting flapper member further comprises developing a pressure differential across a flow tube to urge the flow tube against the flapper member.

* * * * *